US005520525A

United States Patent [19]

Mizuno et al.

[11] Patent Number: 5,520,525

[45] Date of Patent: May 28, 1996

[54] SCROLL COMPRESSOR HAVING WRAPS WITH RECESSES

[75] Inventors: Hisao Mizuno; Kimiharu Takeda, both of Nishi-Kasugai-gun; Hiroyuki Kobayashi; Kazuhiro Sato, both of Nagoya, all of Japan

[73] Assignee: Mitsubishi Jukogyo Kabushiki Kaisha, Tokyo, Japan

[21] Appl. No.: 383,096

[22] Filed: Feb. 3, 1995

[30] Foreign Application Priority Data

Feb. 4, 1994 [JP] Japan ..... 6-012598

[51] Int. Cl.[6] ..... F04C 18/04

[52] U.S. Cl. ..... 418/55.2

[58] Field of Search ..... 418/55.2

[56] References Cited

U.S. PATENT DOCUMENTS 4,781,549 11/1988 Caillat ..... 418/55.2

5,395,222 3/1995 Kawahara et al. ..... 418/55.2

FOREIGN PATENT DOCUMENTS 3264789 11/1991 Japan ..... 418/55.2

*Primary Examiner*—John J. Vrablik

*Attorney, Agent, or Firm*—Wenderoth, Lind & Ponack

[57] ABSTRACT

A scroll compressor in which each of its stationary and swivel scrolls has at least one recess formed in the inner surface of its wrap adjacent to an area of wrap engagement or disengagement. The recess has an inclined edge extending at an angle to the end plate upon which each lap stands upright. The recess enables the wraps to have gradually changing lines of contact with each other along their heights to prevent undesirable noise or vibration during their engagement or disengagement.

4 Claims, 5 Drawing Sheets

SCROLL COMPRESSOR HAVING WRAPS WITH RECESSES

BACKGROUND OF THE INVENTION

1. Field of the Invention

This invention relates to a scroll compressor.

2. Description of the Prior Art

There is known a scroll compressor having a stationary scroll as shown in FIG. 8. The stationary scroll 1 comprises an end plate 11 and a spiral stationary wrap 12 standing upright on the end plate 11 and forming an integral part thereof. The wrap 12 has a uniform height and a uniform thickness and is shaped to for an involute curve. The compressor also has a swivel scroll as shown in FIG. 9. The swivel scroll 2 comprises a disk-shaped end plate 21 and a spiral swivel wrap 22 standing upright on the end plate 21 and forming an integral part thereof. The wrap 22 has a uniform height and thickness and is shaped to form an involute curve. The stationary and swivel wraps 12 and 22 engage each other in the compressor, as shown in FIGS. 10(*a*) to 10(*d*).

FIGS. 10(*a*) to 10(*d*) illustrate the compressing action of the compressor. The swivel scroll 2 revolves with respect to the stationary scroll 1 without rotating about itself. Specifically, the swivel wrap 22 revolves clockwise with respect to the stationary wrap 12, as shown by FIGS. 10(*a*) to 10(*d*). The closed spaces 3*a* and 4*a* which are defined by the stationary and swivel scrolls 1 and 2 as shown in FIG. 10(*a*), gradually diminish in volume and approach the center of the compressor, as shown at 3*b* and 4*b* in FIG. 10(*b*), at 3*c* and 4*c* in FIG. 10(*c*) and at 3*d* and 4*d* in FIG. 10(*d*), until they communicate with a discharge opening 5 in the end plate 11 of the stationary scroll 1. Thus, a coolant gas which is, for example, drawn into the closed spaces 3*a* and 4*a* is gradually compressed, and discharged from the discharge opening 5.

If the swivel scroll 2 revolves from its position as shown in FIG. 10(*d*), in which the end point Y of the inner involute of the swivel wrap 22 is spaced from the stationary wrap 12, to its position as shown in FIG. 10(*a*), the point Y contacts the outer surface of the stationary wrap 12 and thereby defines a point of intake cutoff. This contact cuts off the inflow of the coolant gas and defines the closed space 3*a*. At the same time, the end point X of the inner involute of the stationary wrap 12 contacts the outer surface of the swivel wrap 22, and this contact defines another point of intake cutoff and defines the closed space 4*a*. The swivel scroll 2 thereafter revolves from one position to another as shown in FIGS. 10(*a*) to 10(*d*), and while the stationary and swivel wraps 12 and 22 remain in contact with each other, the points of their contact shift clockwise. As a result, the closed spaces 3 and 4 gradually diminish in volume and approach the center of the compressor, whereby the gas is compressed therein.

FIG. 11 shows the stationary and swivel wraps 12 and 22 immediately prior to the communication of the closed spaces 3 and 4 with the discharge opening 5 during the final stage of gas compression. At the starting point D of its outer involute, the stationary wrap 12 is in contact with the swivel wrap 22 at the starting point C of its inner involute. This contact defines a point of discharge cutoff, and keeps the closed space 3 closed. At the starting point B of its outer involute, likewise, the swivel wrap 22 is in contact with the stationary wrap 12 at the starting point A of its inner involute. This contact defines another point of discharge cutoff, and keeps the closed space 4 closed. After further revolution of the swivel wrap 22, the laps 12 and 22 are disengaged from each other to place the closed spaces 3 and 4 in communication with the discharge opening 5, whereupon the compressed gas starts discharging therethrough.

As is obvious from the foregoing, however, the engagement or contact between the wraps 12 and 22 is discontinuous at the two points of intake cutoff and the two points of discharge cutoff. At the points of intake cutoff, the wraps shift from their open or disengaged position to their closed or engaged position, while the reverse occurs at the points of discharge cutoff. At any such point, the force of contact between the wraps makes a discontinuous and abrupt change which produces a large amount of noise and vibration.

SUMMARY OF THE INVENTION

Under these circumstances, it is an object of this invention to provide a scroll compressor in which no undesirable noise or vibration is produced by any discontinuous or abrupt contact between its stationary and swivel wraps.

This object is attained by a scroll compressor including a stationary scroll and a swivel scroll each having a spiral wrap standing upright on an end plate, the scrolls being so fitted together that their wraps face each other between the end plates, the swivel scroll being movable along an orbital path with respect to the stationary scroll to compress gas, while not rotating about itself, wherein each scroll is provided in its involute surface adjacent to an area of discontinuous engagement with the other scroll with a recess delimited by an inclined edge extending at an angle to the plane in which the end plate lies, so that a line of contact between the wraps gradually changes at the area of discontinuous engagement.

The recess may be provided adjacent to the end point of an inner involute surface of each wrap, the inclined edge extending from the end point in the rearward direction of the involute (i.e. back toward the origin of the involute).

The recess may alternatively be provided adjacent to the starting point of the inner involute surface, the inclined edge extending from the starting point in the direction of the involute (i.e. away from the origin of the involute).

As a further alternative, each wrap may have two such recesses, one adjacent to the ending point of its inner involute and the other adjacent to the starting point thereof.

When the recess is provided adjacent to the end point of the inner involute surface of each wrap, the wraps do not contact each other along the entire height thereof at the points of intake cutoff, but contact each other at only a small part of their height, and as the swivel wrap revolves, the lines of contact of the wraps gradually increase.

When the recess is provided adjacent to the starting point of the inner involute surface of each wrap, the wraps are not disengaged from each other along the entire height thereof at the points of discharge cutoff, but remain in contact with each other along only a small part of their height after having a gradually decreasing lines of contact with each other.

In either event, the wraps have only small lines of contact with each other at the points of intake or discharge cutoff, and do not experience any abrupt change in force at these points. Therefore, the compressor of this invention does not produce any undesirable noise or vibration caused by a change in the state of engagement of the wraps.

DETAILED DESCRIPTION OF THE INVENTION

Figure 1:
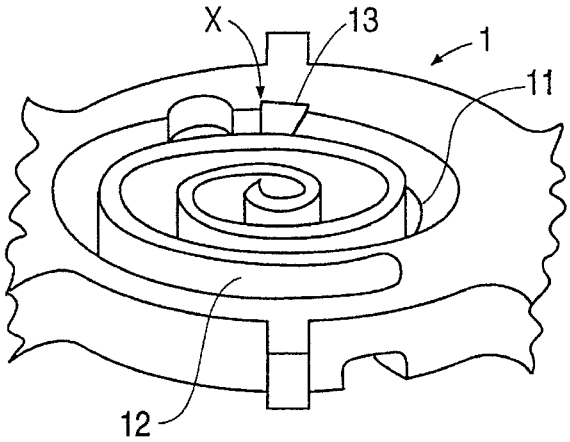
FIG. 1 is a perspective view of a stationary scroll of the first embodiment of a compressor according to this invention.
Figure 2:
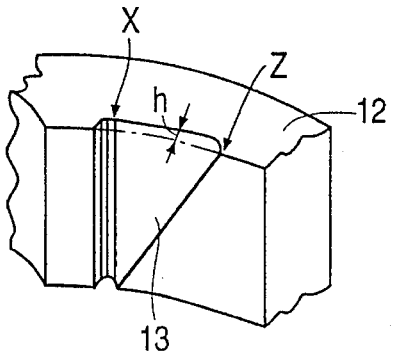
FIG. 2 is an enlarged view of a part of the scroll shown in FIG. 1.
Figure 3:
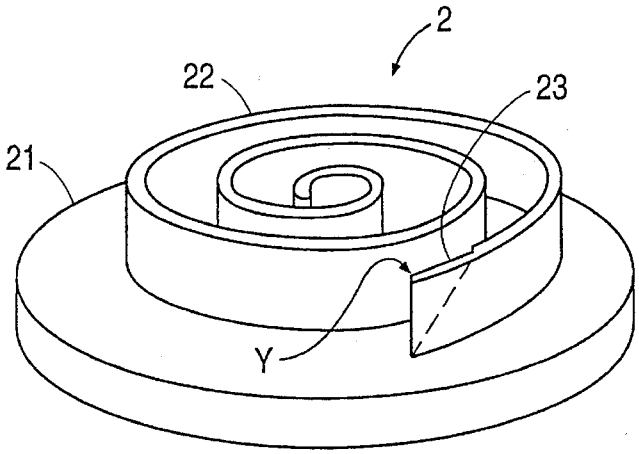
FIG. 3 is a perspective view of a swivel scroll of the compressor.

The first embodiment of a scroll compressor according to this invention is shown in FIGS. 1 to 4. The compressor has a stationary scroll 1 as shown in FIG. 1, and a swivel scroll 2 as shown in FIG. 3. The stationary scroll 1 includes a stationary wrap 12 standing upright on an end plate 11. The wrap 12 has an inner involute ending at a point X. The wrap 12 is provided in its inner surface with a recess 13 having a triangular shape as shown in FIG. 2. The recess 13 extends from point X in the rearward direction of the inner involute of the wrap 12, and terminates in such direction at an inclined edge extending at an angle to the end plate 11. The two-dot chain lines in FIG. 2 show the original surface from which the recess 13 has been cut.

Figure 4:
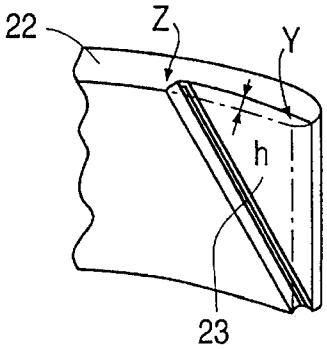
FIG. 4 is an enlarged view of a part of the scroll shown in FIG. 3.

The swivel scroll 2 includes a swivel wrap 22 standing upright on an end plate 21. The wrap 22 has an inner involute ending at a point Y. The wrap 22 is provided in its inner surface with a recess 23 having a triangular shape as shown in FIG. 4. The recess 23 extends from point Y in the rearward direction of the inner involute of the wrap 22, and terminates in such direction at an inclined edge extending at an angle to the end plate 21. The two-dot chain lines in FIG. 4 show the original surface from which the recess 23 has been cut.

The compressor of this invention as described above is characterized by the recesses 13 and 23, each delimited by an edge inclined toward the direction in which the wraps engage, and provided, respectively, adjacent to the end points X and Y of the inner involutes of the wraps 12 and 22 at which the wraps begin to engage each other and define a pair of points of intake cutoff. The recesses 13 and 23 enable the wraps 12 and 22 to contact each other along only a small part of their height at the end points of their inner involutes and provide a line of contact that gradually increases with the revolution of the swivel wrap 22 until the wraps contact each other along their entire height, i.e. upon revolution of the swivel wrap 22 to a point Z (FIG. 2 or 4) at which the recesses 13 and 23 cease to exist. On the other hand, the wraps of the known compressor shown in FIGS. 8 to 11 contact each other along their entire height at the end points of their inner involutes. The gradually increasing distance of contact between the wraps enables a gradual change in the force of their contact and thereby a substantial reduction in noise and vibration. Each recess 13 or 23 has so small a depth h (FIG. 2 or 4) that the leakage of gas therethrough is negligible and does not appreciably affect the performance of the compressor.

Figure 5:
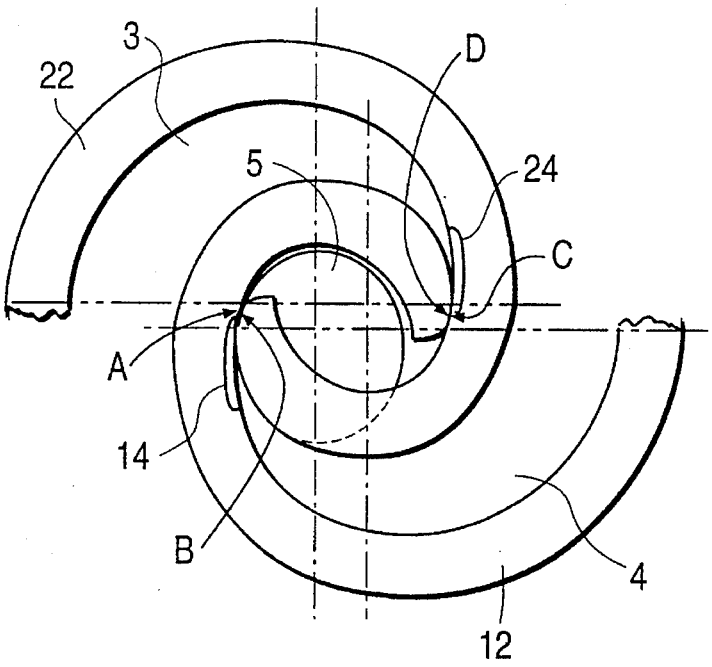
FIG. 5 is a fragmentary sectional view of scrolls of a second embodiment of a compressor according to this invention.
Figure 6:
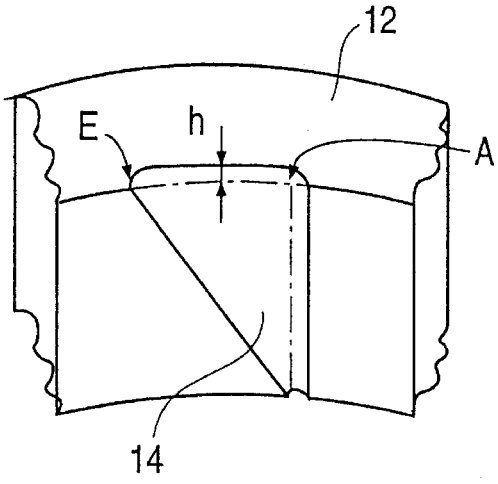
FIG. 6 is an enlarged perspective view of a part of the stationary scroll shown in FIG. 5.
Figure 7:
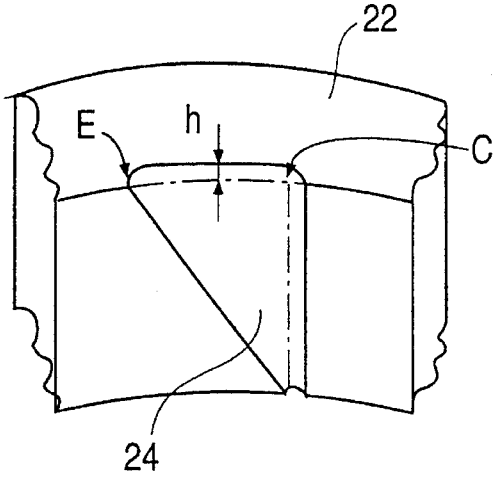
FIG. 7 is an enlarged perspective view of a part of the swivel scroll shown in FIG. 5.
Figure 8:
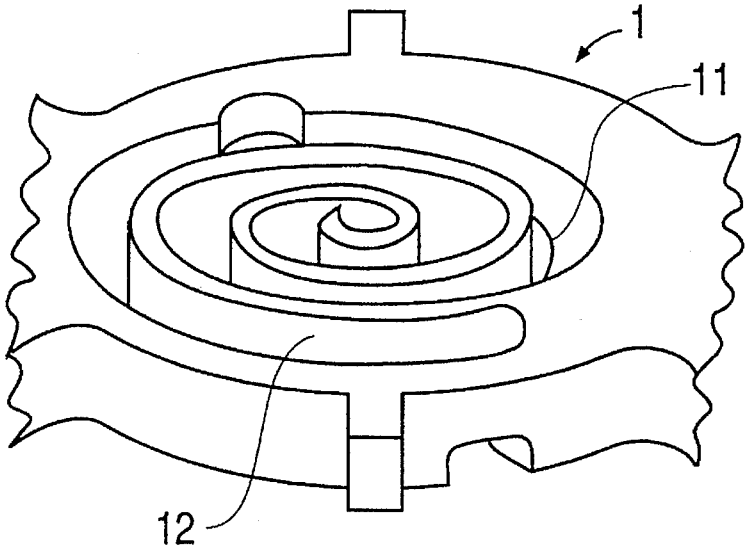
FIG. 8 PRIOR ART
FIG. 8 is a perspective view of a stationary scroll of a known scroll compressor.
Figure 9:
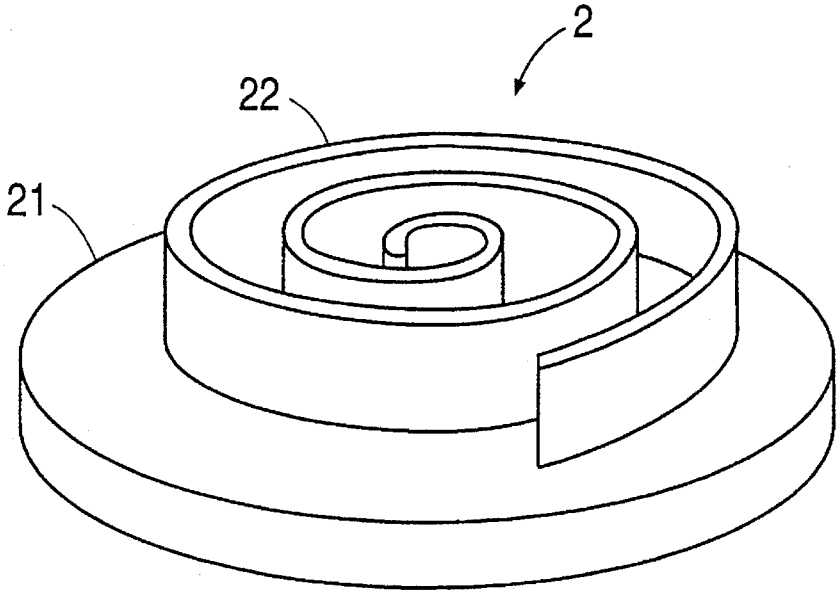
FIG. 9 PRIOR ART
FIG. 9 is a perspective view of a swivel scroll of the known compressor.
Figure 10A:
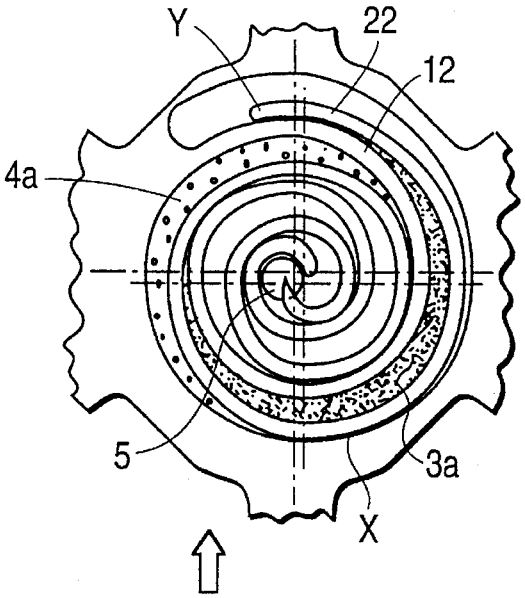
FIG. 10(a) PRIOR ART
FIGS. 10(*a*) to 10(*d*) are a set of views illustrating the operation of the known compressor.
Figure 10B:
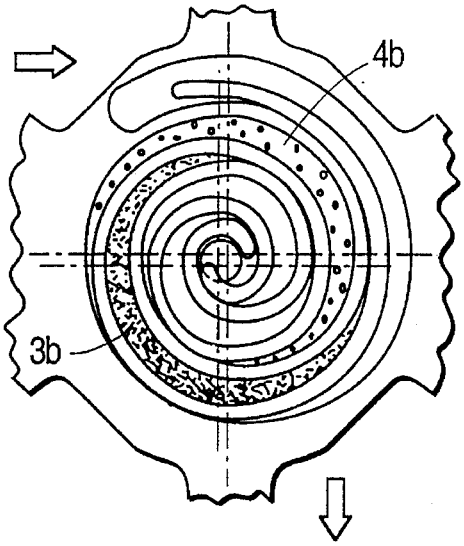
FIG. 10(b) PRIOR ART
Figure 10D:
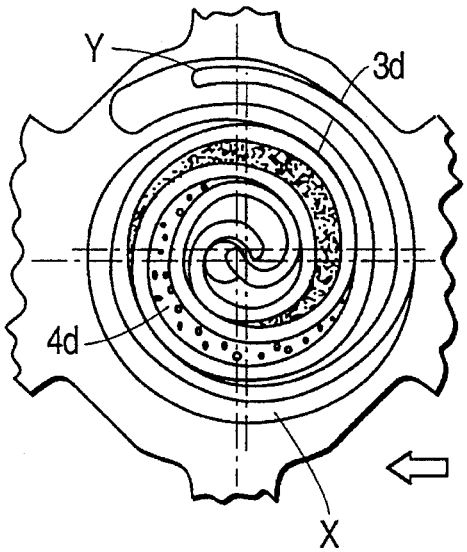
FIG. 10(d) PRIOR ART
Figure 10C:
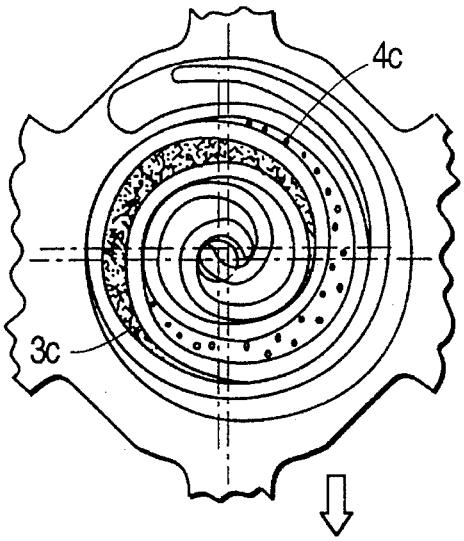
FIG. 10(c) PRIOR ART
Figure 11:
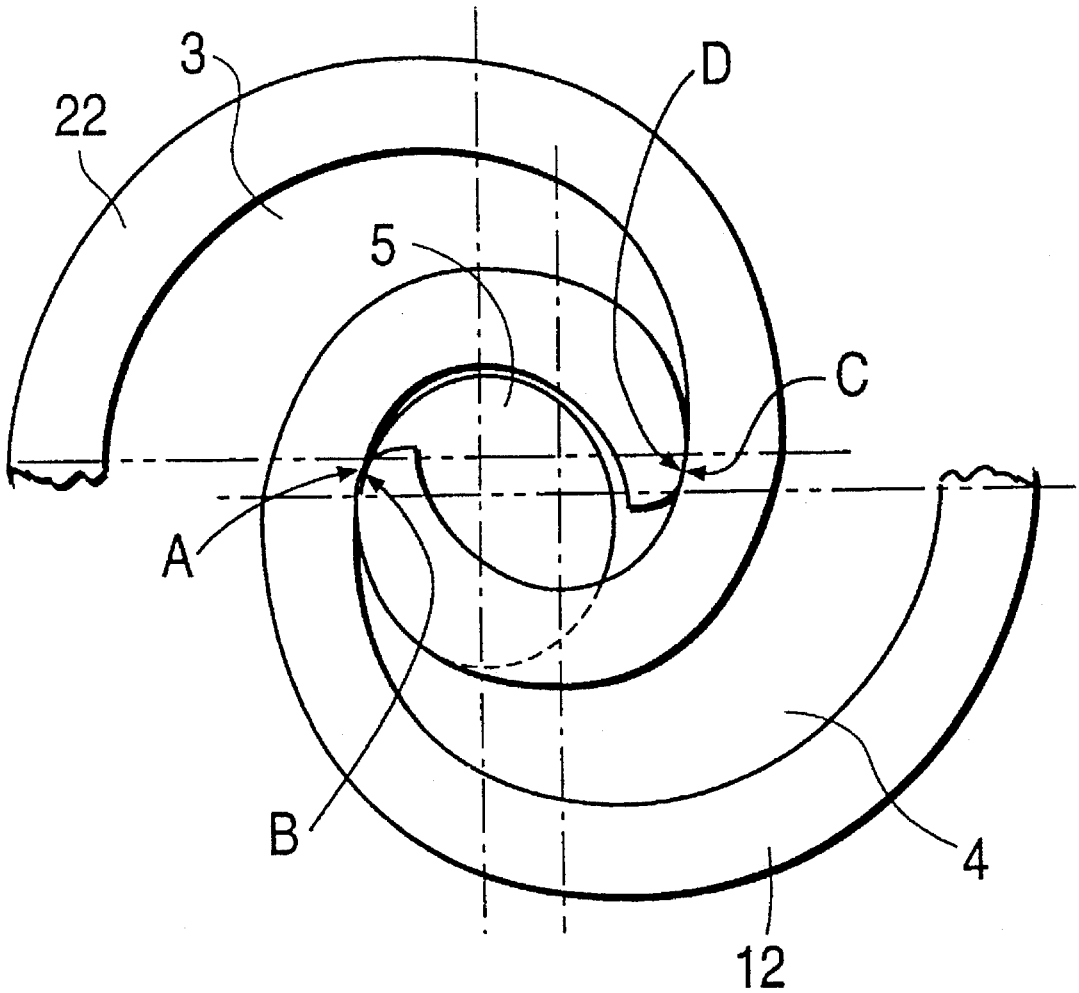
FIG. 11 PRIOR ART
FIG. 11 is a fragmentary sectional view of the scrolls of the known compressor.

A second embodiment of a scroll compressor according to the present invention is shown in FIGS. 5 to 7. It has a stationary wrap 12 and a swivel wrap 22. The stationary wrap 12 has an inner involute starting at a point A and an outer involute starting at a point D, while the swivel wrap 22 has an outer involute starting at a point B and an inner involute starting at a point C. FIG. 5 shows each wrap in a position in which the starting point of its outer involute contacts the other wrap at the starting point of its inner involute to define a pair of points of discharge cutoff adjacent to a discharge opening 5, and two closed spaces 3 and 4.

The stationary wrap 12 has a triangular recess 14 formed in its inner surface and extending from starting point A in the direction of its inner involute, as shown in FIG. 6. The recess 14 terminates in such direction at an inclined edge extending at an angle to the height of the wrap 12. Likewise, the swivel wrap 22 has a triangular recess 24 formed in its inner surface, extending from the starting point C in the direction of its inner involute, and terminating in such direction at an inclined edge extending at an angle to its height, as shown in FIG. 7.

While the wraps of the known compressor are disengaged from each other along their entire height at the starting points of their inner involutes, the recesses 14 and 24 enable the wraps 12 and 22 of this embodiment to start their disengagement from each other at points E (FIGS. 6 and 7) at one corner of each recess and to have gradually decreasing lines of contact toward the origins of their inner involutes. This enables a gradual change in the force of contact between the wraps and therefore, a substantial reduction in noise and vibration. Although each recess has a very small depth h (FIG. 6 or 7), there may be some reduction in the performance of the compressor, since compressed gas is more likely to leak out through the recesses.

A modified form of scroll compressor embodying this invention may have all of the four recesses 13, 14, 23 and 24 as described above. With respect to the remaining structure and operation, the scroll compressor of this invention is substantially identical to the known apparatus shown in FIGS. 8 to 11.

What is claimed is:

1. In a scroll compressor including a stationary scroll and a swivel scroll each having an end plate and a spiral wrap standing upright on the end plate, the swivel scroll being movable in an orbital path relative to said stationary scroll that causes a respective end point of an involute surface of the spiral wrap of each one of the scrolls to come into engagement with the other of the scrolls to form a pair of points of intake cutoff, and that subsequently causes a respective starting point of an involute surface of the spiral wrap of each one of the scrolls to come into engagement with a starting point of an involute surface of the spiral wrap of the other of said scrolls to form a pair of points of discharge cutoff between which a discharge pocket is formed by the wraps, the improvement wherein said scroll wraps have recesses in their involute surfaces, respectively, adjacent at least one of said pairs of points of cutoff, and each of said recesses being delimited by an edge extending obliquely to a plane in which lies the end plate of the scroll having the wrap in which the recess is formed, whereby the wraps have lines of contact adjacent said at least one of the pairs of points of cutoff that vary as the swivel wrap moves over said orbital path relative to said stationary scroll.

2. The improvement in a scroll compressor as claimed in claim 1, wherein the involute surfaces in which said recesses are defined are inner involute surfaces of each of the wraps, the recesses are defined in said inner involute surfaces adjacent said end points thereof that form said pair of points of intake cutoff, and each of the edges which delimits a said recess extends from the end point obliquely away from the plane in which the end plate lies in a direction along the inner involute surface back toward the origin of the involute of the inner involute surface.

3. The improvement in a scroll compressor as claimed in claim 1, wherein the involute surfaces in which said recesses are defined are inner involute surfaces of each of the wraps, the recesses are defined in said inner involute surfaces adjacent said starting points thereof that form said pair of points of discharge cutoff, and the edge which delimits a said recess extends from the starting point obliquely away from the plane in which the end plate lies in a direction along the inner involute surface away from the origin of the involute of the inner involute surface.

4. The improvement in a scroll compressor as claimed in claim 1, wherein the involute surfaces in which said recesses are defined are inner involute surfaces of each of the wraps, the recesses are defined in said inner involute surfaces adjacent both said end points and said starting points thereof that form said pair of points of intake cutoff and said pair of points of discharge cutoff, each of the edges which delimits a said recess defined adjacent a said end point extends from the end point obliquely away from the plane in which the end plate lies in a direction along the inner involute surface back toward the origin of the involute of the inner involute surface, and each of the edges which delimits a said recess defined adjacent a said starting point extends from the starting point obliquely away from the plane in which the end plate lies in a direction along the inner involute surface away from the origin of the involute of the inner involute surface.

* * * * *